US005129115A

United States Patent [19]

Higgins et al.

[11] Patent Number: 5,129,115

[45] Date of Patent: Jul. 14, 1992

[54] METHOD OF PREFILLING AND SUPPORTING PERSON ON FLUID FILLED BODY SUPPORT SYSTEM

[75] Inventors: Larry Higgins; Terence A. Scott, both of Carthage; Wilton J. Davis; Earl W. Kennedy, both of Joplin, all of Mo.

[73] Assignee: L&P Property Management Company, Chicago, Ill.

[21] Appl. No.: 724,850

[22] Filed: Jul. 2, 1991

Related U.S. Application Data

[60] Continuation-in-part of Ser. No. 631,371, Dec. 20, 1990, abandoned, which is a division of Ser. No. 256,902, Oct. 12, 1988, Pat. No. 4,982,466.

[51] Int. Cl.[5] ..... A47C 27/08

[52] U.S. Cl. ..... 5/453; 5/455; 5/914

[58] Field of Search ..... 5/453, 455

[56] References Cited

U.S. PATENT DOCUMENTS

| | | | |
|---|---|---|---|
| 2,245,909 | 6/1941 | Enfiajian | 5/453 |
| 3,583,008 | 6/1971 | Edwards | 5/453 |
| 4,662,012 | 5/1987 | Torbet | 5/455 |

*Primary Examiner*—Rodney M. Lindsey
*Assistant Examiner*—Michael J. Milano
*Attorney, Agent, or Firm*—Wood, Herron & Evans

[57] ABSTRACT

A method of maintaining spinal alignment of a person reclining atop an air mattress which has a plurality of isolated zones along the length of the mattress inflatable to different preset pressures, which method comprises filling each zone of the mattress with air at a predetermined initial prefill pressure and then locating a person in a reclining position atop the mattress so as to cause the pressure in the individual zones of the mattress to change to the preset pressures previously established as appropriate to achieve spinal alignment of the person reclining atop the mattress.

12 Claims, 3 Drawing Sheets

METHOD OF PREFILLING AND SUPPORTING PERSON ON FLUID FILLED BODY SUPPORT SYSTEM

This application is a Continuation-In-Part Application of application Ser. No. 07/631,371 filed Dec. 20, 1990 now abandoned, which is, in turn, a Division of application Ser. No.: 07/256,902, filed Oct. 12, 1988, now U.S. Pat. No. 4,982,466 both of which are assigned to the Assignee of this Application.

This invention relates to fluid filled body support systems, and, more particularly, to air bed sleeping systems intended generally for home use but also capable of medical applications.

BACKGROUND OF THE INVENTION

Restful sleeping is usually associated with comfort, and comfort is in turn associated with minimum body shifts during the course of a night. Recognized major causes of body shifts while sleeping, and hence, poor sleep, are the buildup of pressure on prominences of the body and poor postural support. Pressure on prominences of the body causes tissues of the body at those prominences to be put in compression so as to restrict capillary blood flow to those prominences. The pressure which causes a discontinuance of capillary blood flow is called ischemic pressure. Fifteen inches of water (28 mmHg) is normally considered to be the ischemic threshold. Those parts of the body which are subjected to pressures above the ischemic threshold cause discomfort, and hence, cause the person to shift the body to eliminate the distress and remove the excessive pressure from those prominences.

The lack of postural support from an improper mattress causes distortion of the spine. Distortion of the spine can occur within or beyond the normal physiological range of motion of the spine depending on the structural condition of the spine. As distortion occurs in the spine, ligaments are stretched and joint integrity is compromised. Nerve receptors within the ligaments and joints detect distortion and relay it to the brain where it is received on a conscious or subconscious level. Action is taken on a conscious or subconscious level to relieve the distortion by movement of the body. Spinal alignment can only be obtained when the natural curves of the body are maintained whether in the supine or side lying position.

There are in the prior art disclosures of air mattresses which attempt to maintain subischemic pressures over the full body and to provide uniform support of the body. Examples of such patents are U.S. Pat. Nos. 4,662,012; 4,005,236; and 3,605,145; and British Patent No. 1,545,806.

Torbet U.S. Pat. No. 4,662,012 represents one attempt to obtain subischemic pressure and spinal alignment of a person reclining atop a multiple zone air mattress. According to the disclosure of this patent, the zones are maintained at predetermined pressures at all times, both, when a person is resting atop the mattress and when the mattress is unoccupied. As a consequence, air must be bled off of the zones of the mattress when a person reclines atop the mattress in order to maintain the predetermined low pressures and additional air must be pumped into the zones when a person gets up off of the mattress in order to reinflate the zones to the predetermined pressure. Additionally, the pressure in the zones must be adjusted as the person reclining on the bed changes position on the mattress. This inflation and deflation of the zones of the mattress requires relatively expensive pumps and control equipment, the expense of which limits the application of the mattress.

It has therefore been an objective of this invention to provide a relatively inexpensive air bed which has many of the advantages of air beds disclosed in the above-identified Torbet patent.

Still another objective of this invention has been to provide a minimally expensive air bed having an inexpensive inflation control system for maintaining the bed at optimal pressures for achieving spinal alignment when a person is resting atop the mattress.

Still another objective of this invention has been to provide a relatively inexpensive air bed which may be customized or tailored for each person utilizing the bed for maximum comfort of that person and without the need for expensive controls to achieve that comfort level.

SUMMARY OF THE INVENTION

These objectives are achieved by a fluid filled mattress formed from a pair of air impermeable sheets of polyvinyl plastic, each sheet being vacuum formed to provide a plurality of rows and columns of recesses or pockets. The two sheets, when placed together on a central plane, have their recesses aligned and projecting to each side of the plane so as to form cells. The sheets are sealed around the periphery of the sheets, and the cells are sealed all the way around their perimeters, except for about a one and one-half to one and three quarters inch gap between the corners of each cell, which gaps permit communication among the cells. Preferably, each cell is about 8 inches deep. The seals between adjacent cells are approximately ¼ inch wide, so the cells are substantially contiguous to one another.

The mattress is divided into zones, preferably five but possibly as few as three, by sealing completely between transverse zones. The invention of this application contemplates that the individual zones of a mattress will be prefilled with air at a sufficiently low and appropriate pressure that when a person reclines atop the mattress, the pressures of the individual zones will increase to the preset "normalized" pressures, which normalized pressures are appropriate for maintaining spinal alignment of the person reclining atop the mattress.

The invention of this application also contemplates that the mattress may be customized for a specific person's profile and weight by prefilling the individual zones of the mattress to the pressures appropriate for that specific person or by adjusting the volume of the individual zones of the mattress for this specific person's weight and profile.

In accordance with the invention of this application, one preferred embodiment of this invention utilizes a mattress in which all of the individual zones of the mattress are prefilled to differing but specific pressures, such that when a person reclines on the mattress, the pressures in the zones increase to the normalized pressures predetermined for achieving spinal alignment of the person. In another embodiment of the invention, all of the zones of the mattress are inflated to the same or a common prefilled pressure. In this second embodiment, the volume of each zone is predetermined such that when a person reclines atop the zone of that volume, the common air pressure in each zone increases to the differing pressures in each zone appropriate for maintaining spinal alignment of the person reclining atop the mattress.

Both embodiments of the invention of this application contemplate that the mattress may be customized to adjust for spinal alignment of a specifically configurated person reclining atop the mattress, either by varying the pressure in the individual zones in the first embodiment or by varying the volume of the zones in the second embodiment, such that only when a person of that specific weight and configuration reclines atop the mattress, does it adjust to the pressures required to achieve spinal alignment of that specific person.

In order to customize the first embodiment of the prefilled mattress, wherein the prefilled pressures of the zones are varied, the mattress is initially filled with air at low pressure without the presence of a person upon the mattress. The person for whom the mattress is to be customized then lies down on the mattress and while reclining atop the mattress will have the pressure in each of the zones adjusted to the predetermined pressure required for spinal alignment i.e., pressures equal to 4", 6", 11", 8" and 4" of water in the head, shoulder, waist, hip and foot zone respectively. Thereafter, the person will get off of the mattress and the pressures of the zones remaining in the mattress will then be recorded. Those pressure levels will then be the prefill pressures required in the zones when the person is off of the mattress in order to achieve spinal alignment when that specific person is resting atop the mattress.

This technique for customizing an air bed for a particular person is useful in merchandising inexpensive minimal applied pressure fluid filled beds having pressures which provide spinal alignment of a person reclining atop the bed. Customers may be sold a bed with a relatively inexpensive system for pumping the individual zones of the bed to predetermined pressure and without the need for any expensive regulators or controls for each of those zones. To merchandise a customized maximum comfort air bed, utilizing the first embodiment of the invention described hereinabove, the individual zones of the air bed can be inflated without the presence of the customer on the bed. After inflation of all of the cells of the zones, the customer can be placed atop the bed and the pressure in the zones adjusted to the normalized pressures as set forth hereinabove. After adjustment of those zones to the normalized pressures set forth hereinabove, the customer is removed from the bed, and the remaining pressure in each of the zones recorded. All the air can then be removed from the mattress and the mattress transported home by the customer. The customer then need only inflate each of the zones of the mattress to the levels which were recorded when the customer had been removed from the bed. These inflation levels, absent the customer on the bed, will, when the customer reclines on the bed, be reestablished at the pressures required for subischemic pressure levels and for spinal alignment of that particular person.

To merchandise a customized version of the second embodiment of the invention, i.e., the variable volume version, described hereinabove, the volume of air for each zone is predetermined for each different height and weight customer. The customer then is placed upon a mattress having all zones initially filled to the same prefilled pressures and with the appropriate additional volume compartments connected to the zones to achieve the appropriate "normalized" pressures in the zones when the customer is reclining atop the mattress.

It will be appreciated that the mattresses described hereinabove may be customized in these same ways when filled with a gas other than air or even with a liquid or with a gas and a liquid.

These and other objectives and advantages of this invention will be more fully appreciated from the following description of the drawings in which.

Figure 1:
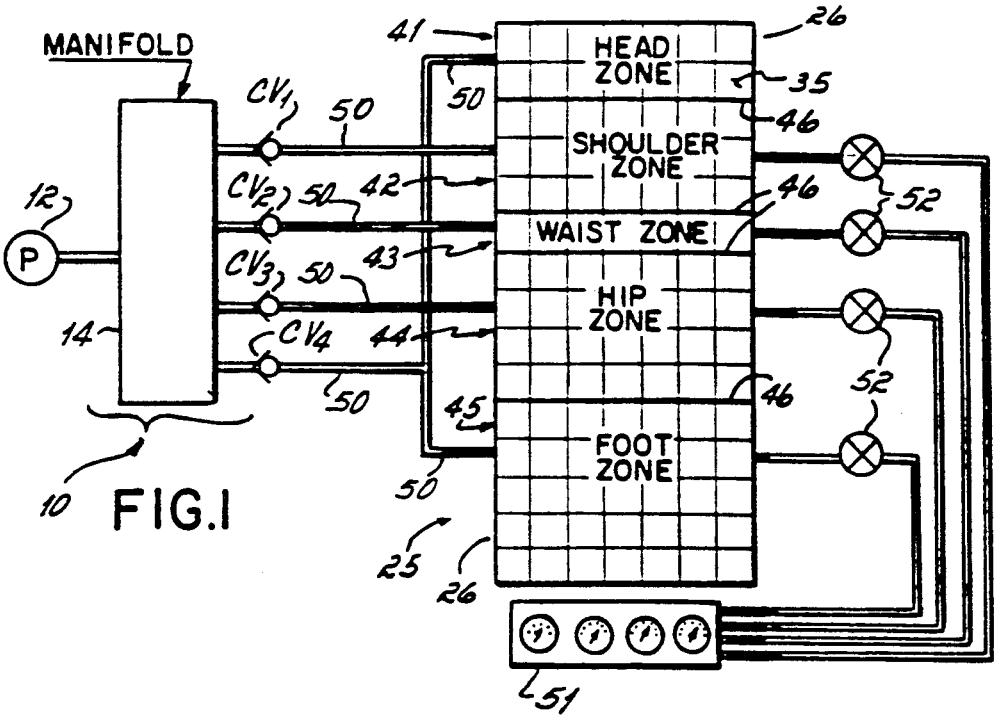
FIG. 1 is a diagrammatic illustration of an air bed embodying the invention of this application.
Figure 2:
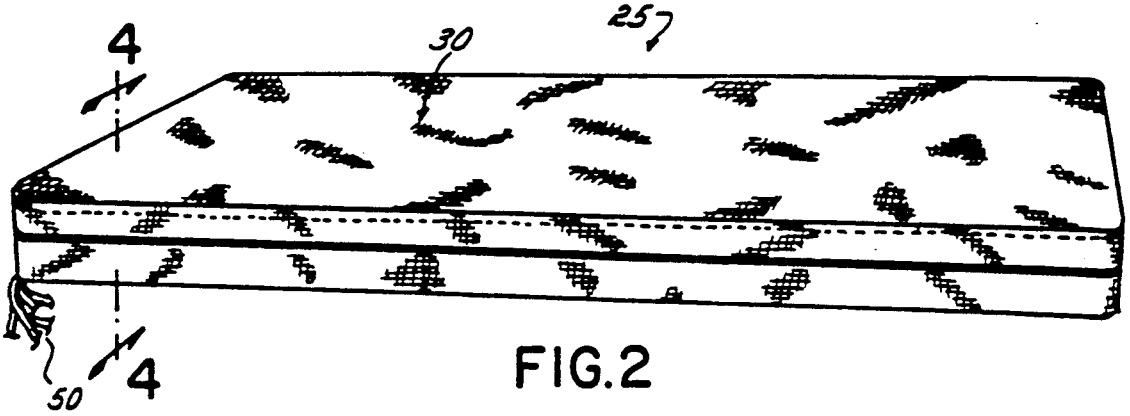
FIG. 2 is a perspective view of an air mattress and cover encasing that mattress utilized in the practice of the invention of this application.
Figure 4:
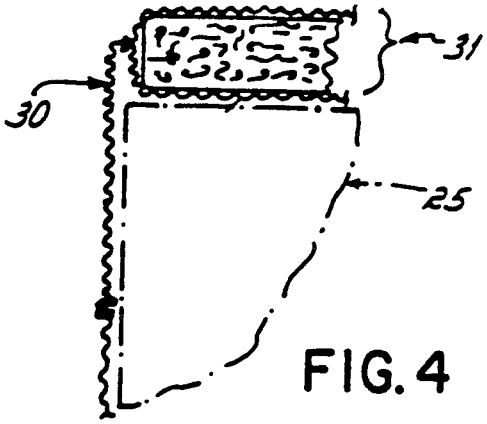
FIG. 4 is a cross-sectional view taken on line 4—4 of FIG. 2.

With reference first to FIG. 1, there is diagrammatically illustrated an air bed 10 embodying the invention of this application. This air bed comprises an air supply pump 12 operable to supply air pressure through a manifold 14 to an air mattress 25. As shown in FIGS. 2 and 4, the air bed 10 includes a cushion 31 and a cover 30 encasing and surrounding the air mattress 25.

Air Mattress

Figure 3:
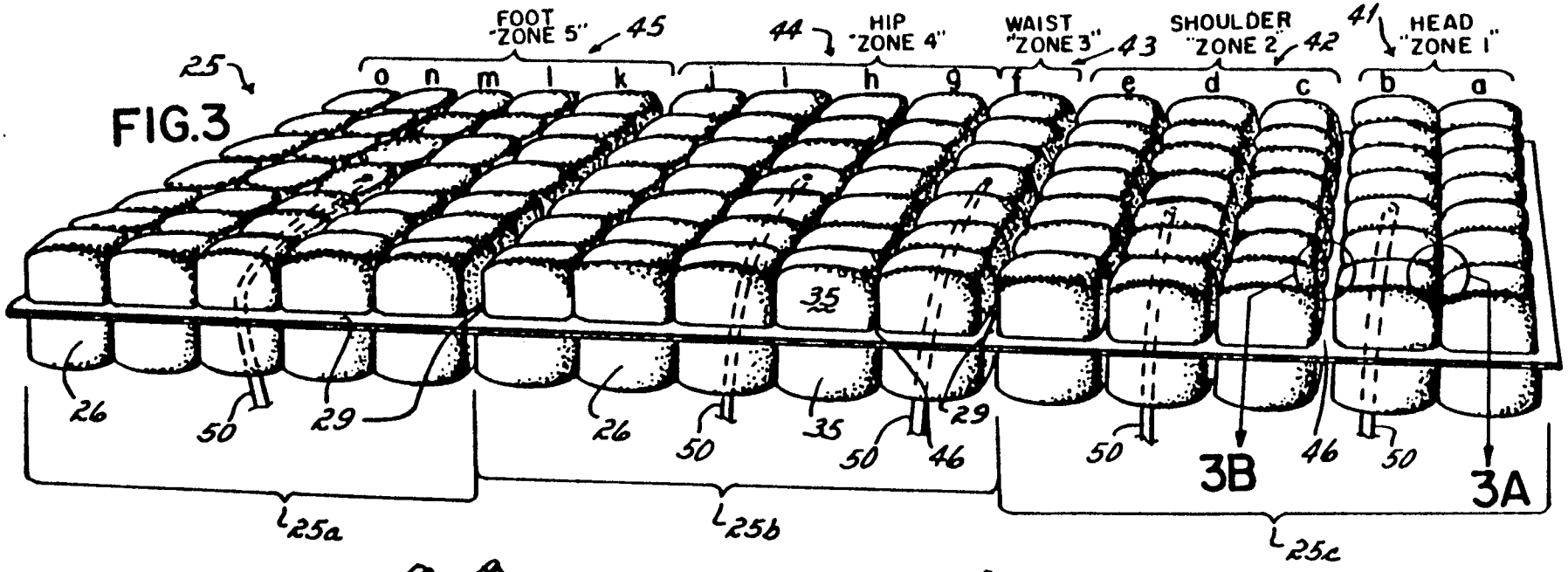
FIG. 3 is a perspective view of the air mattress only of FIG. 2.

The mattress 25 is formed from three separate individual sections *25a, 25b, 25c* which, when placed end to end as illustrated in FIG. 3, form a complete mattress. As illustrated in FIG. 3, each section comprises five rows 26 of cells 35, each row 26 of which in the illustrated embodiment is seven cells wide.

Figure 3A:
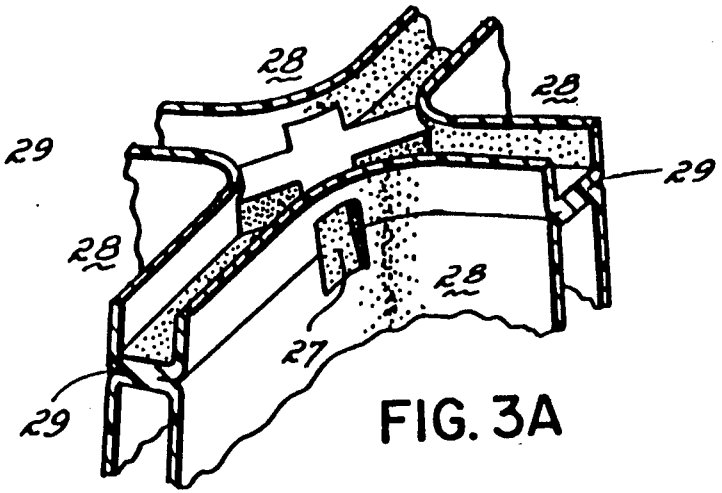
FIGS. 3A and 3B are enlarged views of the respective encircled areas 3A and 3B of FIG. 3.
Figure 3B:
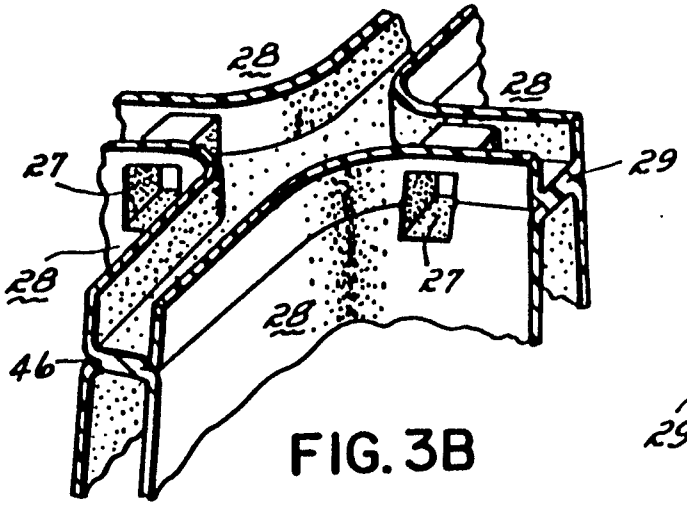

Each mattress section *25a, 25b, 25c* is formed from two sheets of 50 mil (0.050 inches) vinyl. Each sheet is heated and vacuum formed to provide a series of recesses or pockets 28 (FIGS. 3A, 3B). The two sheets overlie each other with the pockets facing each other. The sheets are sealed around the edges 29 and between adjoining pockets 28 except at the intersecting corners of the pockets.

The pockets are square in cross section with the seals 29 being formed between adjacent pockets in order to form the cells 35. As best shown in FIGS. 3A, 3B, the seals 29 between adjoining cells 35 are not completely formed within any zone. Rather, channel or groove 27 of between ¼ inch to ½ inch channel or groove in width is provided at the corners between adjacent cells. These grooves are formed in the manner described hereinbelow with vertical walls between adjacent cells. The gap or width of the groove 27 between adjacent cells within any zone is sufficient to permit a uniform distribution of air among all the cells of a zone and permits a shifting of air from cell to cell as a sleeper shifts his position on the mattress. The vertical walls of the grooves 27 prevent collapse of the grooves as a sleeper shifts on the mattress.

Each pocket 28 is approximately 4 inches deep, so that each cell 35 is about 8 inches in height. Each square is about 5 inches across opposed sides. The square cells, when inflated, have semi-spherical ends which may be drawn with a minimum thinning of the wall thickness.

The mattress 25 is divided into five zones. Zone 1, formed by two rows a and b and indicated at 41, is a head zone which extends from the upper end of the bed to about the neck area of a person reclining atop the bed. Zone 2, formed by rows c–e and indicated at 42, is a shoulder zone which underlines the shoulder area from the waist to the neck of the person reclining atop the sleeper. Zone 3, formed by a single row f and indicated at 43, is a waist zone which underlies the waist of a person reclining atop the mattress. Zone 4 formed by rows g, h, i and j and indicated at 44 is a hip zone which receives the hips and pelvic area of a person reclining atop the mattress. The fifth and last zone, Zone 5, formed by rows k–o and indicated at 45, is a foot zone which receives the legs and feet of the person reclining atop the sleeper. Four continuous transverse seals 46 close the gaps between adjoining cells and thus divide the mattress into the five zones 41–45.

Each zone 41–45 has an air connection or hose, indicated at 50, which connects the zone to the air supply pump 12 via check valves, $CV_1$–$CV_4$. This source of pressurized air supplies air to each of the zones to maintain those zones at predetermined prefill pressure levels, as explained more fully hereinafter. Those prefill pressure levels are preestablished so that when a person reclines on the top of the mattress, the pressures in the zones will rise to preestablished "normalized" pressure levels. These "normalized" pressures are the minimal pressures which have been determined to be effective to maintain most people in spinal alignment when reclining atop the mattress with their waist located over the waist zone 43. Each zone, the respective rows and cells comprising it, and the preferred normalized air pressure levels in it, are set forth in the chart below.

| Zone | Body Section | Rows | Water Pressure | Pressure Hg |
|---|---|---|---|---|
| 1 | head | a,b | 4" $H_2O$ | 7.5 mm Hg |
| 2 | shoulder | c–e | 6" $H_2O$ | 11.2 mm Hg |
| 3 | waist | f | 11" $H_2O$ | 20.5 mm Hg |
| 4 | hip | g–j | 8" $H_2O$ | 14.0 mm Hg |
| 5 | foot | k–o | 4" $H_2O$ | 7.5 mm Hg |

By combining Zones and 5, the head and foot zones, a minimum of four different normalized pressures can be employed in the five zones. To that end, the head and foot zones are connected to a common pressure supply line 16.

When a person reclines on the top of the mattress 25, the body weight causes the air pressure in the zones to increase, and the volume to decrease. It is this phenomenon which the invention of this application employs to achieve "normalized" pressure in the zones with a minimally expensive pump 12 and air flow control system.

In the use of the mattress 25, the person reclining atop the mattress positions their waist to overlie the sixth row f of cells. This row, which occupies the waist zone, is inflated to a pressure greater than that of the other zones when a person is reclining atop the mattress. Thereby, the waist of a person reclining atop the mattress is retained in a relatively neutral position for good spinal alignment. By spinal alignment, it is meant that alignment of the spine which the spine maintains when that same person is standing in a relaxed attitude with their feet approximately 12 inches apart. The mattress of this invention is operative to maintain that spinal alignment while the person reclines either on their side or on their back atop of the mattress. The normalized pressures in the zones maintain those zones in a condition so as to achieve this spinal alignment.

Variable Prefill Pressure Mattress

The air bed of this invention utilizes a relatively inexpensive and simple airflow control system for establishing and maintaining the normalized air pressure in each of the zones of the bed while still achieving spinal alignment of a person reclining atop the bed. In accordance with a first embodiment of this invention, air pressure gauges 51 (FIG. 1) are connected to each of the zones of the mattress, or alternatively, a single gauge, may be associated with a hand or foot pump for inflating the different zones. In the practice of customizing this first embodiment, all of the zones of the mattress 25 are initially filled with air to relatively high pressures as for example 10 inches of water, without the presence of a person on the mattress. This may be done by simply directing air pressure from the pump 12 through the manifold 14 and valves (not shown) contained internally of the manifold to the zones of the mattress. After filling of the mattress, the person who is to ultimately use that mattress as a sleeping surface, lies down atop the mattress with their waist located over the waist zone 43. The air pressures in the zones 41–45 are then adjusted by their respective manual relief valves 52 to deflate the zone until the appropriate normalized pressure for spinal alignment is established in the zones, i.e., pressures approximately equal to 4 inches of water in the head and foot zones, 6 inches of water in the shoulder zone, 11 inches of water in the waist zone, and 8 inches of water in the hip zone. After establishment of these pressures in the zones 41–45 while the ultimate user is reclining atop the mattress, the person then gets off the bed and reads the pressure levels remaining in each of the zones 41–45 of the mattress on the gauges 400 or on the gauge associated with the pump. Those pressures will, of course, be less than the pressures which were established when the person was reclining atop the mattress. Those lesser pressures are then recorded and are the pressures which will be maintained in the bed whenever the person who is to be the ultimate user of the bed is not reclining atop the mattress.

This technique for customizing an air bed to a single person's use is particularly useful in merchandising inexpensive, but very comfortable, air beds which maintain spinal alignment of the person who is to ultimately sleep atop the bed. Such customers may be sold a bed with a relatively inexpensive air pump and gauge or gauges for pumping the individual zones of the bed to the predetermined recorded lesser pressure levels such that whenever the customer again is reclining atop the mattress, the higher normalized pressures, i.e. 4, 6, 11, 8 and 4 inches of water, will be reestablished in the head, shoulder, waist, hip and leg zones, respectively. Thereby, pump and air flow controls and valves are minimized for establishing and maintaining normalized pressures in an air bed, which normalized pressures are operable to maintain spinal alignment of the person sleeping on the bed.

Variable Volume, Common Prefill Pressure Mattress

Figure 5:
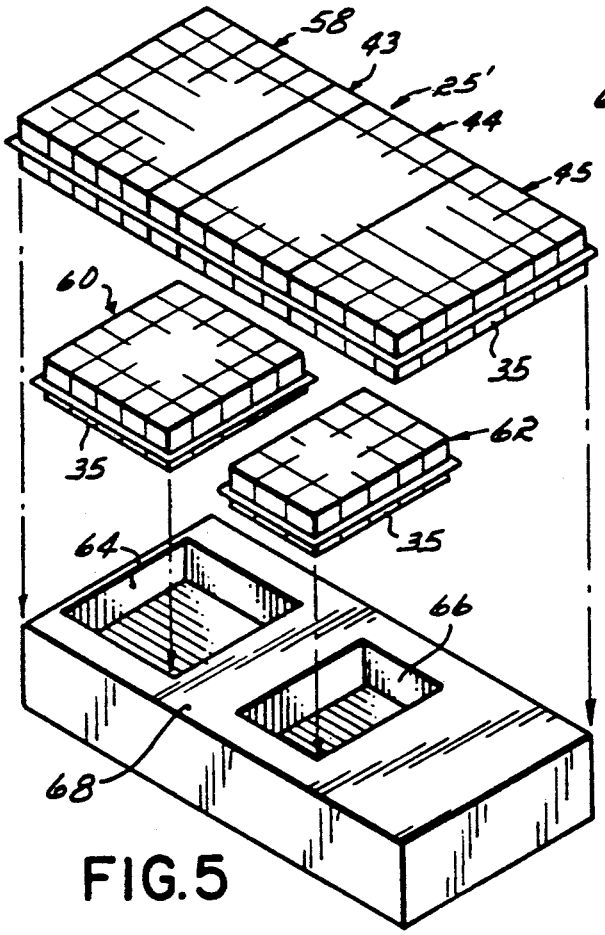
FIG. 5 is an exploded perspective view of a second embodiment of pre-filled air mattress bed, utilizing the invention of this application.
Figure 6:
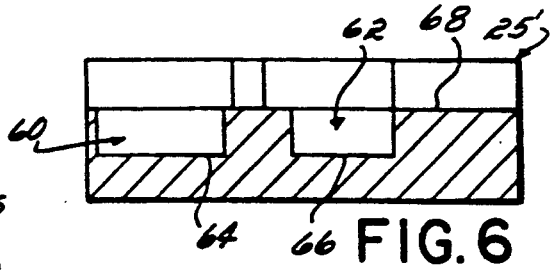
FIG. 6 is a cross-sectional view of the bed of FIG. 5.
Figure 7:
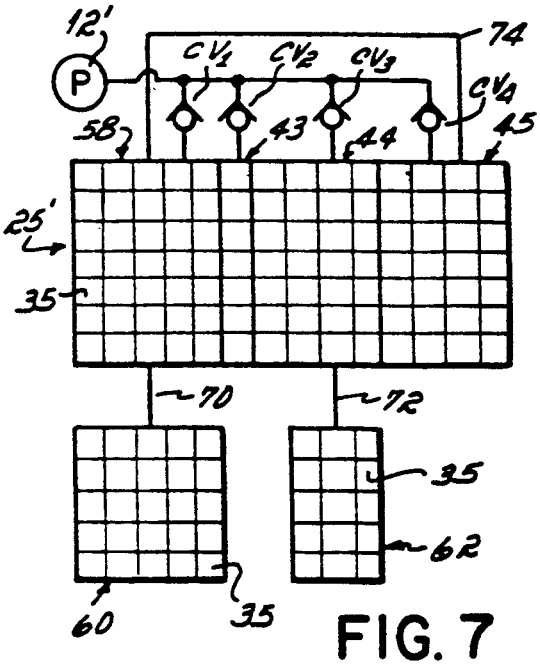
FIG. 7 is a diagrammatic view of the bed of FIGS. 5 and 6.

With reference now to FIGS. 5, 6 and 7, there is illustrated a second embodiment of the invention of this application. In this embodiment, the mattress 25' is identical to the air mattress 25 except that the head and shoulder zones, 41 and 42, respectively, are combined into a zone 58 rather than being separate zones. Additionally in this embodiment, the pump 12 is connected directly to all 4 zones 58, 43, 44 and 45 via check valves $CV_1$-$CV_4$. As a consequence of this construction between the individual zones and the pump, the zones 58, 43, 44 and 45 are all filled to the same common prefilled pressure. In the preferred embodiment, this pressure is a pressure between 2 and 6 inches of water.

The mattress 25' of this invention also differs from the embodiment illustrated in FIGS. 1 through 4 in that the shoulder zone 58 has an additional section of air mattress 60 connected thereto, and similarly, the hip zone 44 has an additional section 62 of air mattress connected thereto. These additional sections 60 and 62 of air mattress function as large balloons connected to the shoulder and hip zones, respectively of the mattress 25'. The section 60 comprises 25 cells identical in volume to the cells 35 of the mattress 25. Similarly, the section 62, comprises 15 cells, 35' identical in volume to the volume of cells 35 of the mattress 25. The additional section 60 connected to the shoulder zone, thus effectively increases the volume of air contained in the shoulder zone by approximately 71 percent. And similarly the section 62 connected to the hip zone effectively increases the volume of that air contained in the hip section by approximately 53 percent.

The additional mattress sections 60, 62 may be spaced from and housed apart from the mattress 25. Alternatively, and as illustrated in FIGS. 5 and 6, the additional sections 60, 62 of mattress may be housed beneath the mattress 25' in depressions 64, 66 of a mattress supporting bed platform 68. In lieu of a special platform 68 for supporting the air mattress, a conventional box spring could be utilized to support the mattress, in which event, the additional sections 60, 62 would simply be placed beneath the bed and connected to the shoulder and hip zones of the mattress via long flexible tubes or conduits 70, 72.

The invention of the embodiment illustrated in FIGS. 5 through 7, is predicated upon the concept that the pressure ultimately achieved in each of the shoulder, hip, waist and foot zones of the mattress 25, when a person is reclining atop those sections, may be controlled by controlling the volume of each zone or section. As a person reclines atop an air inflated mattress, the weight of that person causes the volume of the mattress to decrease, assuming as in the mattress of this application, that the mattress is made from an inelastic material. The degree to which the mattress or in this case the individual zones of the mattress decrease in volume when a person reclines atop those zones is a function of the pressure (weight) and the area over which the pressure (weight) is applied to the zone. Thus, when a person reclines atop the mattress 25' which has been prefilled with air to a pressure of, as an example, 3 inches of water, the volume of each of those zones, 58, 43, 44 and 45 will diminish. Simultaneously, the pressure will rise and the amount of increase in pressure will be a function of the volume of air contained in the shoulder zone, hip zone, waist, and foot zone, respectively. By controlling the volume, as for example, by adding the volume of the section 100 to the shoulder zone 58, the pressure increase in the shoulder zone may be controlled. Similarly, in each of the other zones, the pressure increase resulting from a person reclining atop the mattress may be controlled by controlling the volume of each zone or section in the prefilled air mattress illustrated in FIGS. 5 through 7. Increasing of the volume of the shoulder zone by approximately seventy-one (71%) percent and increasing the volume of the hip zones by approximately fifty-three (53%) percent, was found to be all that was required in order to achieve a prefilled air mattress pressure in four separate zones which would achieve spinal alignment of a relatively average person reclining atop the mattress when all of the zones of the mattress were prefilled with air at a prefilled air pressure from 2 to 6 inches of water pressure.

In operation, the air mattress of FIGS. 5 through 7, is prefilled to an air pressure between 2 and 6 inches of water pressure when there is no one reclining atop the mattress. This inflation of the mattress may be connected to a timer operable to operate a very simple pump periodically to insure that any leakage which occurs in the mattress is automatically compensated for and the mattress reinflated. Air pressure from the pump is supplied through the check valves $CV_1$-$CV_4$ to each of the zones 58, 43, 44 and 45 of the air mattress. Since the additional sections of mattress 60, 62 are connected to the shoulder zone 58 and hip zone 44, respectively, those additional sections are also inflated to the same pressure. When the mattress is in use, a person reclining atop the mattress positions himself or herself with their waist located over the waist zone 43. Thereby the shoulders and hips are properly positioned over the appropriate zones of the mattress. Because of the relative volume of these zones, the pressure applied to the zones over the occupied area of the mattress, will in most instances, i.e. for a large percentage of the population, achieve spinal alignment of the person reclining atop a mattress configurated as is the mattress of FIGS. 5 through 7, i.e. with 4 zones and with 2 additional mattress sections 60, 62, sized as described hereinabove.

Because of the presence of the one-way check valves, $CV_1$-$CV_4$, located between the pump 12" and the intake ports of the mattress, when a person reclines atop the mattress and the air pressure in the zones 58, 43, 44 and 45 is caused to increase as a consequence of the person reclining atop the mattress, the zones will achieve differing pressures, except for the shoulder and foot zones 58 and 45 which are interconnected by a flexible hose, 74. As a consequence of this interconnection, these two zones will at all times be of the same pressure.

As an example of the use of the bedding system illustrated in FIGS. 5 through 7 for supporting an individual in a reclining position of spinal alignment atop the mattress, the mattress illustrated in these figures was inflated to a prefilled pressure of 3 inches of water. Thereafter, an individual measuring 72 inches in height and weighing 185 lbs. was placed reclining on his side atop the mattress with his waist located over the waist zone 43. When the pressure in each of the zones stabilized, it was found that the air pressure in these zones was 6.8, 8.9, 8.2, and 6.8 inches of water in the shoulder, hip, waist and foot zones, respectively. When this person rolled onto his back, these pressures changed slightly but remained relatively stable. From experience and from spinal alignment measurements, it has been found that these pressures, all of which are subischemic, are very satisfactory for achieving spinal alignment of a large percentage of the adult population.

Figure 8:
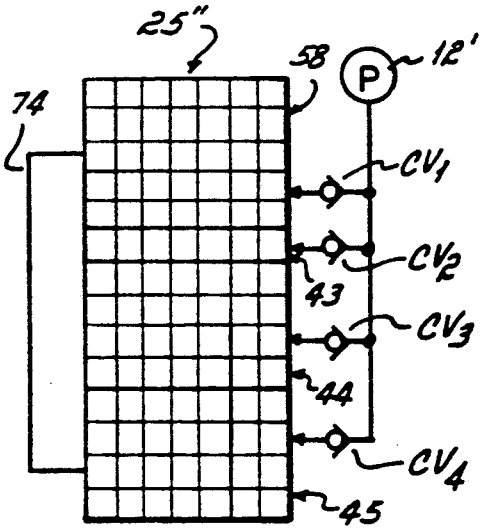
FIG. 8 is a diagrammatic illustration of a further modification of a pre-filled air bed embodying the invention of this application.

With reference now to FIG. 8, there is illustrated diagrammatically, an air bed which is identical to the air bed of FIGS. 5 through 7, except that it omits from the air mattress, the additional mattress sections 60, 62. In all other respects, the air mattress 25" is identical to the air mattress 25" of FIGS. 5 though 7. Obviously though, the air mattress 25" would be supported upon a flat surface, rather than upon a surface having depressions 64, 66 as in the embodiment of FIGS. 5 through 7. In this embodiment, the prefilled air mattress is utilized in the same way that the mattress of FIGS. 5 through 7 is utilized. That is, the air mattress is periodically inflated with a prefilled air pressure, usually on the order of 2 to 6 inches of water pressure. This prefilling of the mattress occurs when the mattress is unoccupied. After filling of the air mattress with the prefilled air pressure, the individual zones of the mattress are sealed against the egress of air by the check valves $CV_1$–$CV_4$, such that the pump 12" may be turned off and need only be reactivated to refill the mattress periodically to compensate for any air which might have leaked from the mattress.

The relative volumes of the different zones, 58, 43, 44 and 45 of the air mattress 25" and the fact that the shoulder and foot zones are interconnected by the air line 74, enables the mattress, when prefilled with a low air pressure, to increase in pressure as a consequence of a person reclining atop the mattress to zone pressures which are relatively close to those which are ideal for maintaining spinal alignment of a person reclining atop the mattress. Specifically, a mattress configured as the mattress illustrated in FIG. 8 was used to support a man 72" inches in height and weighing 185 lbs. When that man was positioned in a reclining position on his side with his waist over the waist zone 43, and his shoulders on the shoulder zone (41 and 42), the pressures in the shoulder, waist, hip and foot zones were found to increase to 7.4, 9.6, 9.1, and 7.4 inches of water pressure respectively. These pressures will change from one person to another because of relative dimensional and density differences but these pressures are suitable for obtaining approximate spinal alignment for a large percentage of the adult population.

Figure 9:
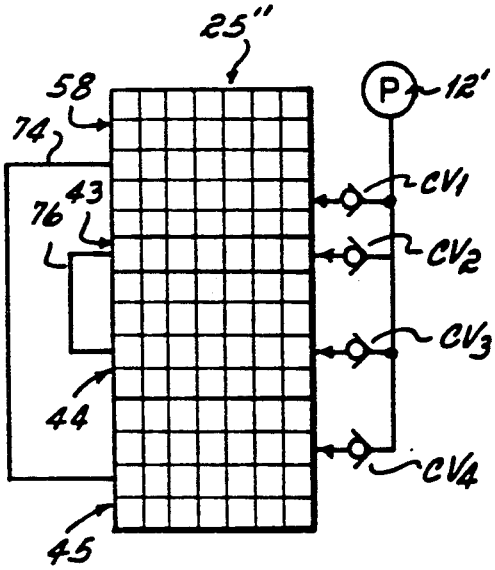
FIG. 9 is a diagrammatic illustration of another modification of prefilled air bed embodying this invention.

With reference now to FIG. 9, there is illustrated yet another embodiment of a prefilled air mattress similar to the air mattress of FIG. 8. This embodiment differs from the air mattress of FIG. 8, only in that the hip and waist zones are interconnected by a connecting air line 76. As a consequence of this interconnection, the air mattress of FIG. 9 would have hip and waist zones at the same pressure when the bed was occupied. When the bed of FIG. 9 was used to support the same person as in the example described hereinabove relative to the FIG. 8 embodiment, and when the bed was prefilled to the same prefilled pressure of 3 inches of water, the pressure in the shoulder and foot zones was found to be 7.4 inches of water and the pressure in the hip and waist zones was found to be a pressure of 9.2 inches of water.

There are many advantages to the air beds described hereinabove over prior art air beds. The primary advantage of these air beds is the comfort which they achieve for a person reclining atop the bed, which comfort is attributable to the low pressures maintained against all surfaces of the body which rest atop the mattress and the spinal alignment which it achieves while maintaining these low pressures. It achieves these advantages in a relatively inexpensive manner which enables the bed to be used practically as a substitute for a conventional spring or foam mattress.

While we have described only a limited number of embodiments of our invention, persons skilled in this art will appreciate other changes and modifications which may be made while still practicing this invention. Therefore, we do not intend to be limited, except by the scope of the following appended claims:

Having described our invention, we claim:

1. The method of achieving and maintaining spinal alignment of a person reclining atop a fluid inflatable mattress, which mattress has a plurality of isolated zones inflatable to different final preset pressures, which method comprising determining a final preset pressure to which each zone of the mattress is to be inflated when a person is reclining atop the mattress in order to achieve spinal alignment of that person in the reclined position, prefilling each zone of said mattress, to a predetermined initial prefill pressure, sealing said mattress zones against the inflow, or egress of fluid, locating the person in a reclining position atop said mattress while said mattress zones remain sealed against further inflow or egress of fluid so as to cause the pressure of said zones of said mattress to change solely as a consequence of said person reclining atop said mattress to said final preset pressures previously determined as appropriate to achieve and maintain spinal alignment of said person reclining atop said mattress.

2. The method of claim 1 wherein said zones of said mattress are all prefilled to the same initial pressure.

3. The method of claim 1 wherein said zones with said mattress are prefilled to differing pressures.

4. The method of individually customizing inflatable mattresses for maximum sleeping comfort, which mattresses each have a plurality of zones inflatable to different pressures such that a person reclining atop said mattresses is maintained in spinal alignment, which method comprises inflating each zone of one of said mattresses, locating a person atop said mattress while said zones are inflated, adjusting the pressure of all of said zones of said mattress while said person remains reclining atop said mattress until said zones are at predetermined pressures previously established as appropriate to maintain spinal alignment of a person reclining atop said mattress, and removing said person from said mattress and recording the lesser pressures remaining in each of said zones after removal of such person such that said person may thereafter reestablish said lesser pressures in said zones with the knowledge that when reclining atop said mattress, the pressures appropriate for spinal alignment will be reestablished.

5. The method of claim 4 wherein said mattress has at least four zones identifiable as shoulder, waist, hip and foot zones, and wherein the pressures in said zones are adjusted while said person is reclining atop said mattress to pressures of approximately 6, 11, 8 and 4 inches of water, respectively.

6. The method of achieving and maintaining spinal alignment of a person reclining atop a fluid inflatable mattress, which mattress has a plurality of isolated inflatable zones of different volumes, which method comprises determining a final preset pressure to which each zone of the mattress is to be inflated when a person is reclining atop the mattress in order to achieve spinal alignment of that person in the reclined position, inflating each zone of said mattress to a common pressure, sealing said mattress zones against the inflow or egress of fluid with said zones at said common pressure, locating a person atop said mattress while said zones are inflated and while said zones remain sealed against the inflow or egress of fluid, so as to cause the pressure of said zones of said mattress to change solely as a consequence of said person reclining atop said mattress until said zones are at the final preset pressures previously determined as appropriate to achieve and maintain spinal alignment of a person reclining atop said mattress.

7. The method of claim 6 wherein said mattress has at least three zones identifiable as shoulder, waist and hip zones, and wherein said zones inflate in pressure when said person is reclining atop said mattress to pressures which maintain spinal alignment of said person.

8. The method of claim 6 wherein said mattress is generally orthogonal in configuration and which method comprises connecting an inflatable compartment located remote from said orthogonal configurated mattress to at least one zone of said mattress via a fluid flow conduit so as to increase the effective volume of said zone.

9. The method of achieving and maintaining spinal alignment of a person reclining atop a fluid filled mattress, which mattress has a plurality of zones of differing volumes pressurizable to different preset pressures at which a person reclining atop said mattress is maintained by said preset pressures in spinal alignment, which method comprises prefilling each zone of said mattress to a common predetermined initial pressure, adjusting the volume of at least one of said zones of said mattress such that a person reclining atop said mattress while said zones are inflated, causes the pressure of said zones of said mattress while said person remains reclining atop said mattress to change to said preset pressures previously established as approximately appropriate to maintain spinal alignment of said person while reclining atop said mattress.

10. The method of claim 9 wherein said mattress has at least three zones identifiable as shoulder, waist and hip zones.

11. The method of claim 9 wherein each of said zones are initially inflatable to a prefill pressure of between 2 and 6 inches of water.

12. The method of maintaining spinal alignment of a person reclining atop a fluid inflatable mattress, which mattress has a plurality of isolated zones along the length of the mattress, including an isolated waist zone inflatable to different preset pressures, which method comprises determining preset pressure for each of said zones at which a person reclining atop said zones of said mattress will be supported in spinal alignment, prefilling each zone of said mattress, to a predetermined initial prefill pressure, sealing said mattress zones against the inflow, or egress of fluid, locating a person in a reclining position atop said mattress with the waist of the person located over the waist zone while said mattress zones are sealed against further inflow or egress or fluid, causing the pressure of said zone of said mattress to change solely as a consequence of said person reclining atop said mattress, to said preset pressures previously established as approximately appropriate to maintain spinal alignment of said person reclining atop said mattress, said preset pressures including pressure in said waist zone which is higher than the preset pressures in any of the other zones.

* * * * *

UNITED STATES PATENT AND TRADEMARK OFFICE

CERTIFICATE OF CORRECTION

PATENT NO. : 5,129,115

DATED : July 14, 1992

INVENTOR(S) : Larry Higgins et al

It is certified that error appears in the above-identified patent and that said Letters Patent is hereby corrected as shown below:

Column 4, line 58, before "in width", delete "channel or groove".

Column 5, line 49, after "Zones", insert --1--.

Column 10, line 16, "comprising" should be --comprises--.

Signed and Sealed this

Twenty-first Day of September, 1993

Bruce Lehman

*Attest:*

BRUCE LEHMAN

*Attesting Officer*

*Commissioner of Patents and Trademarks*